United States Patent [19]

Belanger

[11] 4,018,014

[45] Apr. 19, 1977

[54] HUB STRUCTURE FOR ROTARY FINISHING WHEELS

[75] Inventor: James A. Belanger, Northville, Mich.

[73] Assignee: Belanger, Inc., Northville, Mich.

[22] Filed: May 7, 1976

[21] Appl. No.: 684,440

[52] U.S. Cl. ..... 51/337; 15/230.14; 15/230.19

[51] Int. Cl.[2] ..... B24D 13/06

[58] Field of Search ..... 51/334, 337; 15/183, 15/179, 230.14, 230.19

[56] References Cited

UNITED STATES PATENTS

| | | | |
|---|---|---|---|
| 2,970,333 | 2/1961 | Jones | 15/183 |
| 2,978,725 | 4/1961 | Whitman | 15/183 |
| 2,978,726 | 4/1961 | Park | 15/183 |
| 3,939,521 | 2/1976 | Clark | 15/179 |
| 3,942,210 | 3/1976 | Clark | 15/179 |

*Primary Examiner*—Al Lawrence Smith
*Assistant Examiner*—Nicholas P. Godici
*Attorney, Agent, or Firm*—Cullen, Settle, Sloman & Cantor

[57] ABSTRACT

A hub structure for a rotary finishing wheel having a rotational axis and being adapted for replaceably mounting a plurality of circumferentially-spaced pack units each of which includes a flap-like member of fill material having a radially outer finishing portion for engaging a workpiece and a radially inner slot-engaging portion for mounting the pack unit. The hub structure includes a plurality of substantially identical hub sections which may be fitted together to form a generally cylindrical hub wall whose outer surface is provided with a plurality of integrally formed, circumferentially-spaced, quasi-cylindrical, key-hole-type slot formations each having a longitudinal slot axis parallel to the rotational axis. Each slot is adapted to telescopically and replaceably receive the slot-engaging portion of a flap-like member for mounting the pack units for limited hinge-type pivotal movement about the slot axis. Plate members, slot plugs or bolt-like, slot-engaging elements are used to axially retain the slot-engaging portions within the slots.

In a first embodiment, the hub structure includes a pair of hub portions each having a generally semi-circular cross-section and integrally formed, radially inwardly disposed clamp seats adapted to clampably engage a shaft for rotation therewith. In a second embodiment, the hub structure includes four arcuate sections adapted to be fitted together in an edgewise overlapping manner to form the outer cylindrical hub wall. A plurality of separate clamping assemblies are disposed within the hub wall and each includes a pair of brackets hub (1) for securing the four arcuate sections together to retainably form the cylindrical hub wall and (2) for clamping the hub wall to the shaft for rotation therewith.

32 Claims, 11 Drawing Figures

HUB STRUCTURE FOR ROTARY FINISHING WHEELS

BACKGROUND OF THE INVENTION

1. Field of the Invention

The present invention relates generally to hub structures for rotary finishing wheels, and more particularly to hub structures having a generally cylindrical, radially outer surface provided with a plurality of integrally formed, circumferentially- spaced, quasi-cylindrical, key-hole-type slot formations adapted to replaceably mount pack units having flap-like members of fill material and an improved clamping means for rigidly securing the cylindrical hub to a shaft for rotation therewith.

The invention finds use in any type of rotary finishing wheel such as those employing abrasive sheets, bristles, or the like which are generally used for grinding, rough or finish abrasive working, brushing, burnishing, or the like. However, in the preferred embodiment of this invention, the improved hub structures are used in commercial automotive car washing establishments which would normally employ cloth, cloth-like material, felt-like material, sewed sisal, pex, horsehair, leather or the like for use in washing, drying, buffing, polishing, or otherwise finishing the car.

2. Description of the Prior Art

My own U.S. Patents are typical of the rotary finishing wheels, hub structures and pack units of the prior art to which this invention relates and the numbers and issue dates of these patents are as follows: U.S. Pat. Nos. 3,455,068, July 15, 1969; 3,535,833, Oct. 27, 1970; 3,621,622, Nov. 23. 1971; 3,626,646, Dec. 14, 1971; 3,685,217; Aug. 22, 1972; 3,768,214, Oct. 30, 1973; 3,772,833, Nov. 20, 1973; 3,798,847, Mar. 26, 1974; 3,800,481, Apr. 2, 1974; 3,807,099, Apr. 30, 1974; 3,813,829, June 4, 1974; 3,820,291, June 28, 1974; 3,842,547, Oct. 22, 1974; 3,914,908, Oct. 28, 1975; and U.S. Pat. No. Re. 28,118, Aug. 20, 1974. In so much as these patent teach various pack units and applications for rotary finishing wheels, they are incorporated by reference herein.

Generally, the hub structures of the prior art have been relatively expensive, complex, and difficult to use and repair. Most of the hub structures employed a number of machined or cast parts which were often relatively heavy and difficult to attach to the rotary drive shafts required to operate the finishing wheels. In many of the hub structures, a plurality of longitudinally oriented pivot rods were used for mounting the pack units or various longitudinally oriented retainer rods were used as an aid in maintaining the cylindrical shape of the hub structure. The hub structures often involved many parts and were difficult to assemble and maintain. Some included a plurality of stacked hub disks which were normally required to be keyed to a specially adapted drive shaft or required additional means for securing the stacked disks to one another.

The improved finishing wheel of the present invention employs a relatively inexpensive, easy to assembly and maintain hub structure adapted for easily and replaceably telescopically mounting modular pack units without the use of retainer rods or the like. The improved hub structure is extremely simple and light weight. For the most part, it comprises two to four integrally-formed pieces and a relatively simple means for securing the pieces together to form a cylindrical hub and for attaching the cylindrical hub to the drive shaft for rotation therewith.

SUMMARY OF THE INVENTION

The improved, relatively simple, light weight hub structure of the present invention is relatively inexpensive, easily assembled and attached to the drive shaft, and is adapted to easily and replaceably mount the pack units telescopically within slots without the use of insertable rods or complex external clamping mechanisms.

The hub structure of the present invention includes a plurality of integrally-formed, shell-like sections adapted to be fitted together to form a generally cylindrical hub wall whose radially outer surface is provided with a plurality of circumferentially-spaced, quasi-cylindrical, key-hole-type slot formations thereon.

Each of the slots on the periphery of the generally cylindrical hub wall is adapted to telescopically and replaceably receive the slot-engaging portion of a flap-like fill member for mounting the pack units for limited pivotal or hinge-type movement about the axis of the slot. Plate members, slot plugs or bolt-like threaded slot-engaging elements may be used to axially retain the slot-engaging portions within the slots.

In one embodiment of the present invention, a hub structure is provided which includes two substantially identical hub sections generally representing the two halves of a longitudinally bisected hollow cylinder, the radially outer surface of which is provided with the slot-forming means. The interior of each of the hub portions includes an integrally-formed, centrally-disposed, radially inwardly extending member having its innermost end adapted to form a clamp seat having the general contour of the shaft to which the hub structure is to be secured and the inwardly extending members are generally perpendicular to the plane of bisection. The interior of each of the hub portions further includes a pair of flange portions generally parallel to the plane of bisection and integral with the longitudinally bisected edge portions of the hub portion. The flange portions extend radially inwardly toward one another and each has its radially inner end adapted to form one-half of another shaft-engaging seat. The hub structure also includes means for adjustably securing each of the pair of flange portions of one hub portion to correspondingly opposed flange portions of the other hub portion so as to form a pair of oppositely disposed, shaft-engaging seats while simultaneously securely clamping the shaft between the clamp seats of the oppositely disposed, inwardly extending members so as to secure the hub structure to the shaft for rotation therewith.

In a second embodiment of the present invention, the hub structure includes four substantially identical, relatively thin-walled, cylindrical sections. Each of the sections includes an elongated, arcuate, shell-like portion whose radially outer surface is provided with the slot forming means. Each of the sections also includes a pair of peripheral flange portions integral with the opposite sides of the arcuate shell-like portion. A first one of the pair of flange portions of each of the sections is disposed closely over a second one of the pair of flange portions of each circumferentially adjacent section in an edgewise overlapping manner when the four sections are fitted together to form the cylindrical hub wall. The hub structure further includes a plurality of clamping means disposed substantially within the cylindrical hub wall for securing the four pairs of radially overlapping flange portions tightly together to rigidly position the sections for retainably forming the cylindrical hub wall and for rigidly clamping the retainably formed cylindrical wall to the drive shaft for rotation therewith.

The clamping means of the second embodiment may include a pair of substantially identical clamping brackets which are not integral with the cylindrical hub wall. Each bracket has a radially inner portion adapted to be clampably secured about the shaft for rotation therewith and a radially outer portion adapted to be rigidly secured to the radially overlapping flange portions for retainably forming the cylindrical hub wall.

It is a feature of this invention to provide an improved hub structure which is relatively inexpensive, simple, and easy to assembly and attach to a drive shaft.

Additionally, it is a feature of this invention to provide such a hub structure whose outer peripheral surface is provided with a plurality of circumferentially-spaced, quasi-cylindrical, key-hole-type slot-forming means so that pack units may be easily telescopically mounted to and removed from the hub structure with a minimum of effort.

It is another feature of this invention to provide an extremely light weight hub structure having a minimum number of parts but which can be easily assembled and attached to an unmodified drive shaft.

Other advantages and meritorious features of the present invention will be more fully understood from the following detailed description of the drawings and the preferred embodiment, the appended claims and the drawings which are described briefly hereinbelow.

DESCRIPTION OF THE PREFERRED EMBODIMENT

Figure 1:
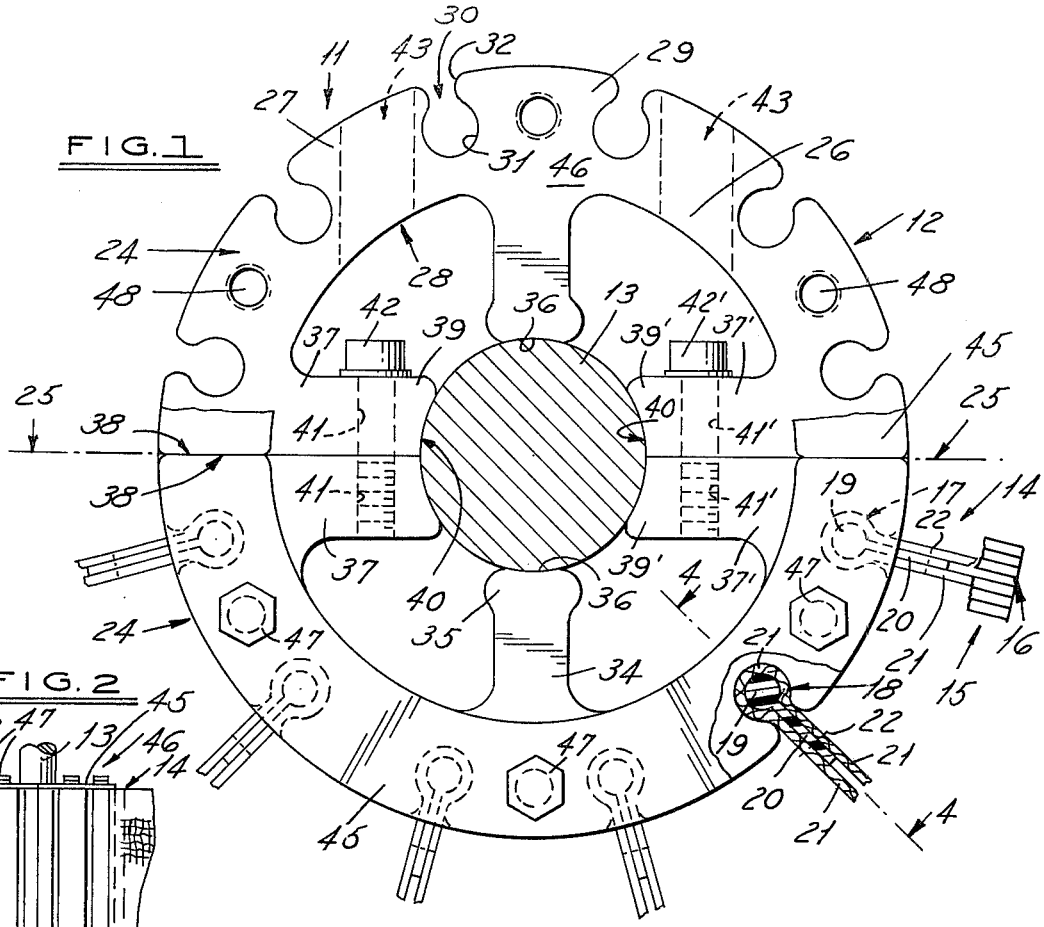
FIG. 1 is a fragmentary end view, partially broken away to show one embodiment of the hub structure of the present invention mounted on a shaft to form a finishing wheel.

FIG.1 shows a fragmentary end view of a finishing wheel 11 having an improved hub structure 12 secured to a drive shaft 13 for rotation therewith. The improved hub structure has a plurality of pack units 14 telescopically mounted about the radially outer cylindrical periphery thereof.

For a more detailed description of the preferred structure of the pack units 14, reference is made to my copending patent application Ser. No. 680,838, which was filed on Apr. 28, 1976 for a Replaceable, One-Piece, Hinge-Type, Slot-Engaging Pack Unit. Briefly, the pack units 14 of the present invention include one or more flap-like members 15 of fill material. Each of the flap-like members 15 includes a radially outer finishing portion 16 adapted for engaging a workpiece and a radially inner slot-engaging portion 17. The slot-engaging portion 17 is quasi-cylindrical in structure and is adapted to be slideably and telescopically received within the slots 30 about the periphery of the hub structure 12.

In the preferred embodiment, the flap-like members 15 each includes an elongated support element 18 having a generally cylindrical bulb-like head or bead portion 19 and a substantially flat elongated fin or flag portion 20 integral with the head portion 19 and extending radially outwardly therefrom. A sheet of flexible cloth-like material 21 is draped tightly over the elongated support element 18 so as to tightly overly the head portion 19 and fin portion 20. The sheet 21 may be secured to the elongated support element 18 or at least to the fin portion 20 thereof in a sandwiched fashion by stitching means 22, but any other form of fastening means such as staples, mechanical or chemical bonding means or the like could also be used to prevent slideable rotation between the sheet 21 and the support element 18. The bulbous head and neck part of the slot-engaging portion 17, which includes the sheet-covered head 19 and part of the fin 20 of the elongated support element 18 are adapted to be slideably and telescopically received within the slots 30 in a replaceable manner.

For the purposes of this invention, the term finishing or finishing operation is used in a generic sense to refer to any conventionally known type of operation such as abrading, burnishing, polishing, buffing, washing, waxing, drying or the like. In the preferred embodiment of the present invention, which is contemplated for use in car washing establishments, the finishing material or fill material of the flap-like members 15 would preferably be cloth, cloth-like material, felt-like material or the like, but in other examples, sewed sisal or cloth, pex, horsehair or leather could be used. For abrading-type applications, flexible abrasive sheets, sewed packs or pads of bristle material, leaves of flexible sheet material coated with abrasive grains or the like could be used as conventionally known. Similarly, as preferred in many finishing applications, the radially outer finishing portion 16 may be provided with a plurality of spaced slits extending generally perpendicular to the rotational axis 23.

The hub structure 12 has a rotational axis 23 coincident with the axis of shaft 13 and includes a pair of substantially identical hub sections 24 generally representing the two halves of a longitudinally bisected cylinder, the plane of bisection being represented by the reference numeral 25. The two hub sections 24 are adapted to be mated to one another to form a generally cylindrical hub wall 26. Each of the hub portions 24 has a generally semicircular, radially outer surface or exterior contour 27 and an interior 28.

The radially outer semi-circular contour 27 of each of the hub sections 24 is provided with a plurality of integrally-formed, circumferentially-spaced, quasi-cylindrical, key-hole-type slot-defining formations 29 for defining a plurality of longitudinal slots 30 which are angularly spaced about the radially outer peripheral surface 27 of the hub portions 24. Each of the slots 30 includes a generally cylindrical interior portion 31 and a restricted neck portion 32 and each of the slots 30 has a longitudinal slot axis 33 which is substantially parallel to the rotational axis 23. As previously described, each of the slots 30 is adapted to slideably and telescopically received the radially inner slot-engaging portion 17 of the flap-like members 15 for replaceably mounting the pack units 14 therein for a limited hinge-type pivotal motion about the slot axis 33.

The interior 28 of each of the hub sections 24 includes an integrally formed, centrally-disposed, radially inwardly extending member 34 whose innermost end 35 is adapted to form a clamp seat 36 which is generally shaped to fit the contour of the shaft 13 to be clampably engaged thereby.

The interior 28 of each of the hub portions 24 also includes a pair of flange portions 37, 37′ which are generally parallel to the plane of bisection 25 and are integral with the longitudinally bisected edge portions 38 of the hub portions 24. The flange portions 37, 37′ extend radially inwardly toward one another and the radially innermost ends 39, 39′ of the flange portions 37, 37′, respectively, are adapted to form one half of a shaft-engaging seat 40.

Each of the flange portions 37, 37′ is provided with an internally threaded aperture 41, 41′ adapted for receiveably engaging an externally threaded bolt-like element 42, 42′ such that as the bolt-like elements 42, 42′ are tightened, the two oppositely disposed hub portions 24 are drawn together. The element 42 threadedly draws the flange portion 37 of the first hub portion 24 tightly against the correspondingly opposed flange portion 37 of the second hub portion 24 while the diametrically disposed bolt-like element 42′ draws the flange portion 37′ of the first hub portion 24 tightly against the flange portion 37′ of the second hub portion 24 so as to form diametrically opposed, shaft engaging seats 40 while simultaneously causing the diametrically opposed clamps seats 36 to engageably clamp the shaft 13 therebetween so as to secure the hub structure 12 thereto for rotation therewith.

Preferably, the inwardly extending members 34 and the flange portions 37, 37′ are integrally formed as a part of the hub sections 24 and extend substantially the entire length thereof. A plurality of the flange apertures 41, 41′ and the bolt-like elements 42, 42′ may be provided along the length thereof to insure that the hub structure 12 is rigidly retained as a generally cylindrical hub wall 26 while being clampably secured to the shaft 13 for rotation therewith. A plurality of access openings or holes 43 may be provided for reaching the bolt-like members 42, 42′ for tightening same and, if desired, the head portions of the bolt-like members 42, 42′ may be provided with sockets or the like for ease of tightening through the access holes 43.

Figure 2:
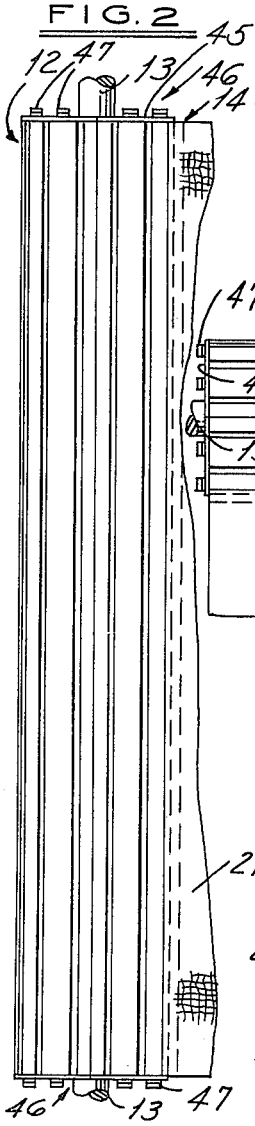
FIG. 2 is a fragmentary top view of the hub structure of FIG. 1.
Figure 3:
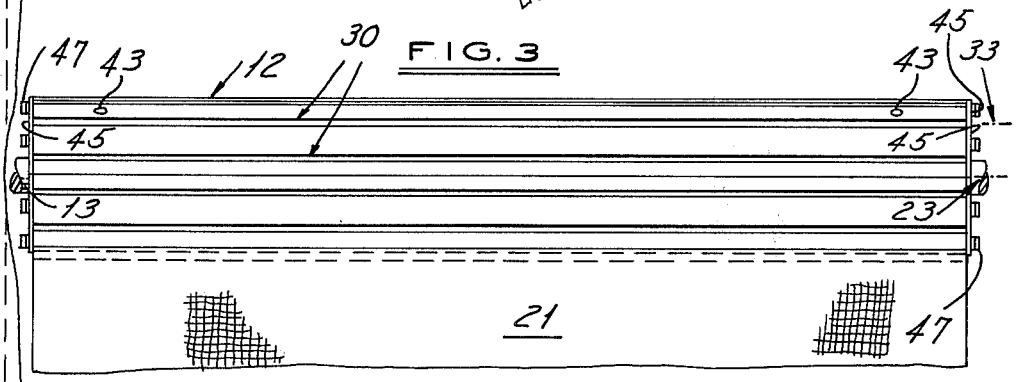
FIG. 3 is a fragmentary side view of the hub structure of FIG. 1.
Figure 4:
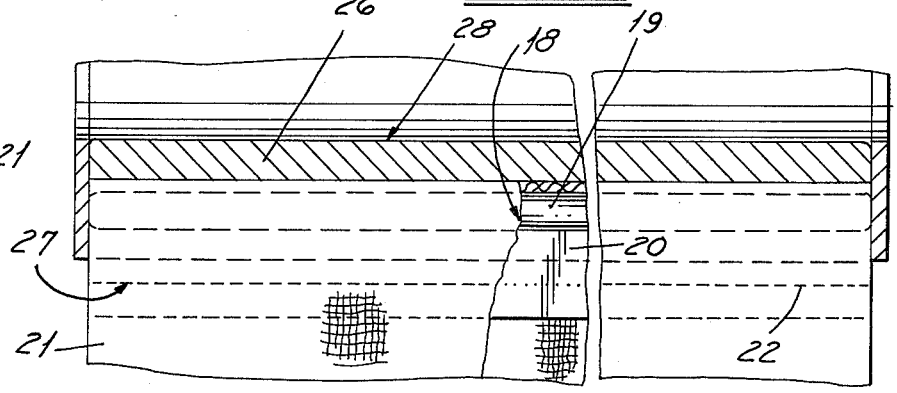
FIG. 4 is a fragmentary enlarged scale view in side elevation of a portion of the hub structure and a fragmentary portion of a pack unit taken along view lines 4—4 of FIG. 1.

FIGS. 1, 2, and 3 illustrate one embodiment of a retaining means 44 for removeably retaining the slot-engaging portions 17 of the flap-like members 15 actually within the slots 30 of the hub portions 24. In this embodiment, the retaining means 44 comprises an annular ring-like end plate 45 which is adapted to be secured to the axial end 46 of the hub portions 24 by plate fastening elements 47, as known in the art. For example, the axial ends 46 of the hub portions 24 may be provided with a plurality of circumferentially spaced, internally threaded apertures 48, the annular plate 45 may be provided with corresponding apertures and the fastening elements 47 may be externally threaded bolts adapted to pass through the apertures in the end plates 45 and threadedly engaged the apertures 48 in the ends 46 of the hub portions 24 to removeably secure the end plate 45 to the axial end 46 of the hub portions 24 so as to close the axial end of the slots 30 and retain the slot-engaging portions 17 of the flap-like members telescopically, therein. The annular end plate 45 may be a single integral circular piece or, alternatively, it may be two semicircular halves adapted for form a completely circular annular ring, or any similar means known in the art.

Figure 5:
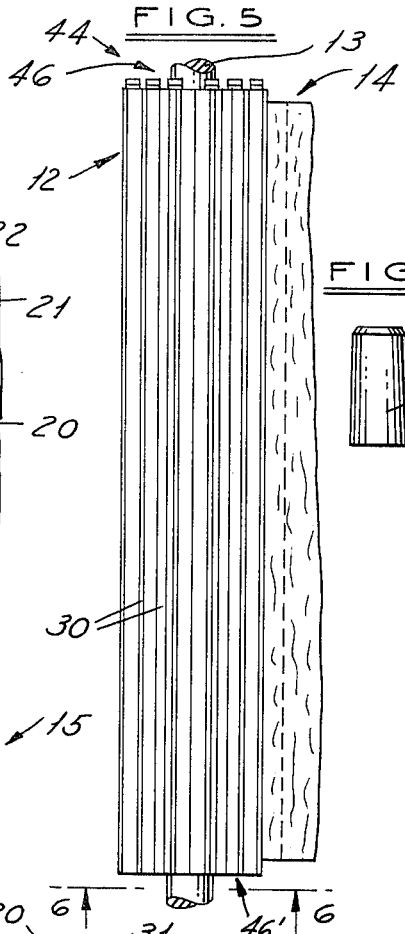
FIG. 5 is a fragmentary top view of the hub structure of FIG. 1.

FIG. 5 shows a top view of another embodiment of the hub structure 12 of this invention and corresponding reference numerals designate corresponding assemblies. The embodiment of FIGS. 5 and 6 disclosed a rotary finishing wheel 11 having a thin-walled hub structure 12 clampably secured to a shaft 13 for rotation therewith. A plurality of pack units 14, similar to those previously described herein and in the previously recited copending Patent Application, are mounted on the hub 12 to form the finishing wheel 11 previously described. The hub structure 12 of FIg. 6 includes two substantially identical, integrally-formed, hub portions 24 which could, for example, be light weight aluminum castings or the like.

Each of the hub sections 24 resembles one half of a longitudinally bisected hollow cylinder bisected along a plane represented by the reference numeral 25. Each of the sections 24 is adapted to be fitted opposite the other about the shaft 13 so as to form a generally cylindrical hub wall 26 having a generally semicircular exterior contour or surface 27 and an interior 28.

The radially exterior surface 27 is provided with a plurality of circumferentially-spaced, quasi-cylindrical, key-hole-type, slot-defining formations 29 about the periphery thereof. Each of the slot-forming means 29 includes a pair of C-shaped members 49, 49′ having their concave surfaces disposed opposite one another for forming a slot 30 therebetween. The C-shaped members 49, 49′ protrude radially outwardly from the otherwise generally cylindrical, radially outer surface 27. The slots 30 are adapted to telescopically and slideably receive the slot-engaging portions 17 of the flap-like members 15 so as to replaceably mount the pack units 14 to the hub portions 24 for hinge-type limited pivotal motion about the slot axis 33, as previously described.

Figure 6:
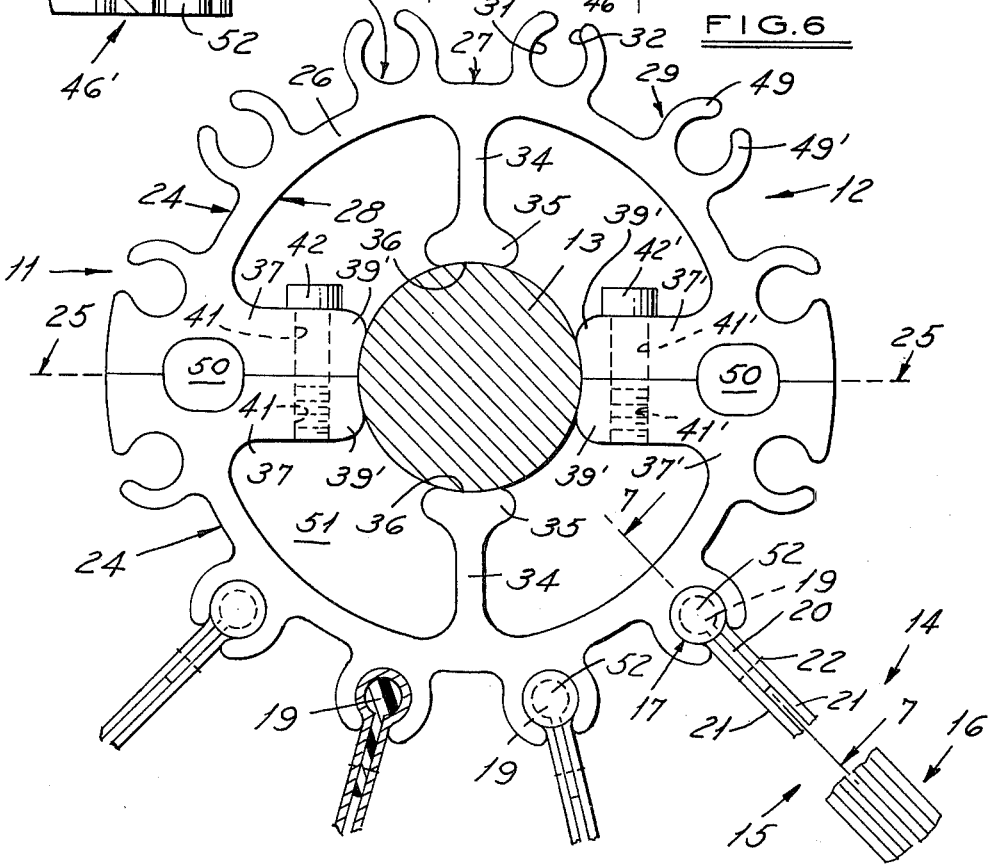
FIG. 6 is a fragmentary end view of an another embodiment of the hub structure of FIG. 1 taken along view lines 6—6 of FIG. 5.

The interior 28 of the hub portions 24 of FIGS. 5 and 6 includes radially inwardly extending members 35 and flange portions 37, 37′ which operate to retainably secure the two hub portions 24 together to form the generally cylindrical hub wall 26 while securely clamping the hub structure 12 to the shaft 13 for rotation therewith.

Additionally, the embodiment of FIG. 6 may include casting apertures 50 in addition to the normally hollow interior spaces 51 to further decrease the weight of the hub structure 12.

Figure 7:
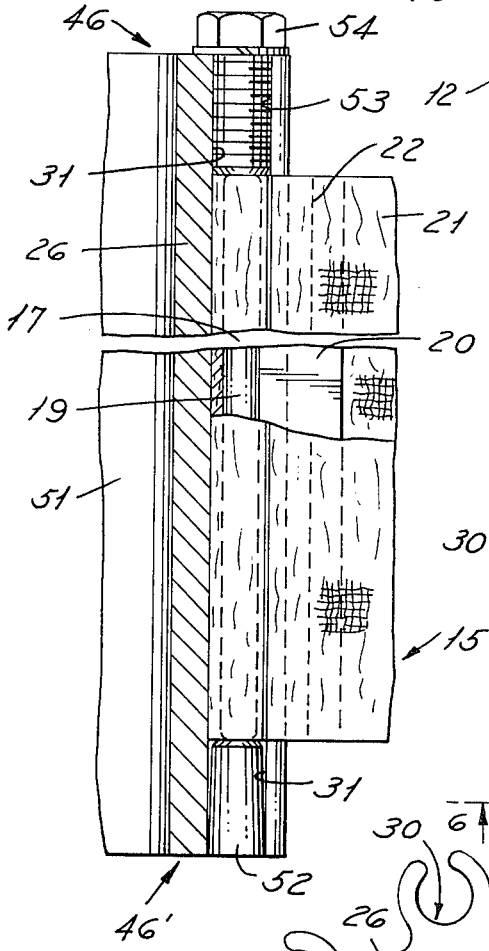
FIG. 7 is a fragmentary enlarged scale view, partially broken away, of one embodiment of the retaining means of the present invention.
Figure 8:
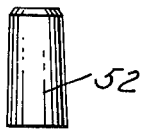
FIG. 8 shows a plug-like member which may be used to permanently close one end of the slot as shown in FIG. 7.

FIGS. 5, 7 and 8 illustrates a second embodiment of the retaining means 44 wherein one axial end 46 of the hub portions 24 is adapted to be removeably closed while the opposite axial end 46′ is adapted to be permanently closed as hereinafter disclosed.

FIG. 8 shows a slot-closing plug element 52 and, as seen in FIG. 7, the plug-like element 52 may be used to permanently close one of the axial ends 46′ to prevent the escape of the slot-engaging portions 17 therefrom. At the opposite axial end 46, the interior surface of the generally cylindrical portion 31 of the slots 30 is provided with internal threads 53 and an externally threaded bolt-like element 54 is adapted to be threadably received within the threaded end of the slots 30 so as to removeably close the axial end 46 of the individual slots 30 of the hub portions 24 to prevent the escape of the slot-engaging portions 17 of the flap-like members 15 therefrom. Similarly, if the application demanded, the plug-like units 52 could be used to permanently close both ends 46, 46′ of the hub portions 24 or, alternatively, both ends 46, 46′ of the hub portions 24 could have the ends of the slots 30 provided with internal threads so that both ends 46, 46′ could be removeably closed by externally threaded bolt-like elements 54.

Figure 10:
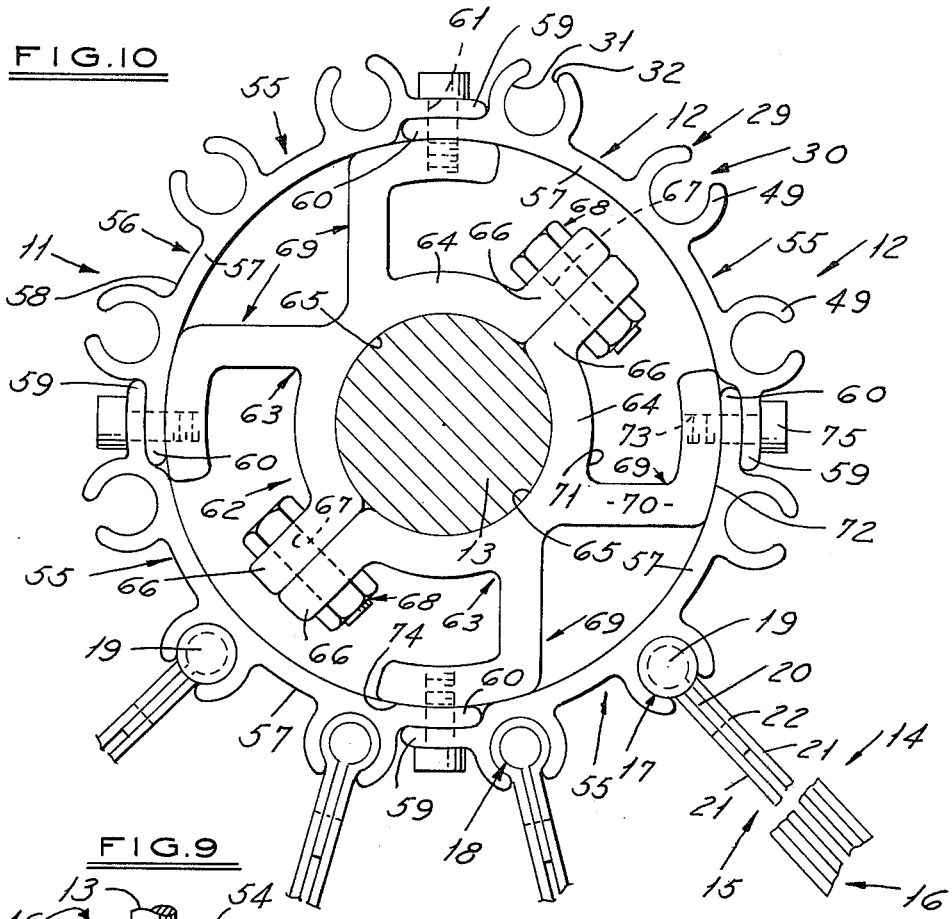
FIG. 10 is a fragmentary enlarged scale end view of the alternate embodiment of FIG. 9 taken along view lines 10—10 thereof.
Figure 9:
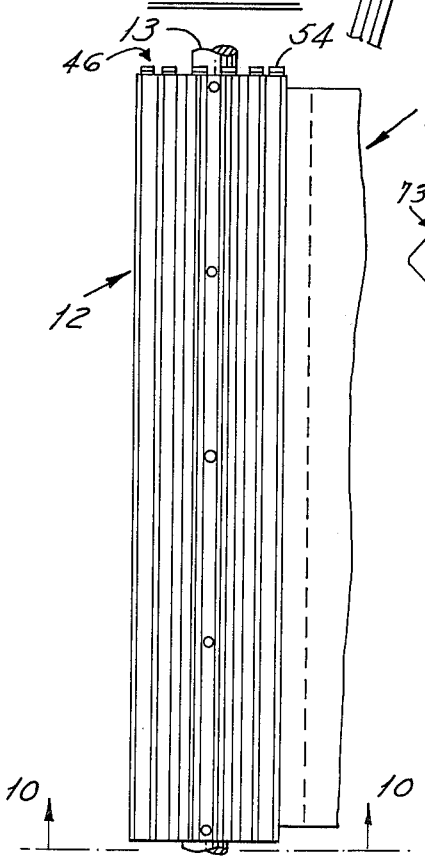
FIG. 9 is a fragmentary top view of another embodiment of the improved finishing wheel of the present invention.

FIGS. 9 and 10 represent an alternative embodiment of the hub structure 12 previously described, but it is adapted to be secured to a shaft 13 for rotation therewith and for mounting a plurality of pack units 14 as previously described.

The hub structure 12 of the embodiment of FIG. 10 includes four substantially identical, relatively thin-walled, cylindrical sections 55 adapted to be placed in overlapping contact with one another to form a radially outer cylindrical hub wall 56. Each of the sections 55 may be an integrally-formed, unitary piece of light weight material such as cast aluminum or the like and each includes an elongated, arcuate shell-like portion 57 whose radially outer surface 58 is provided with a plurality of integrally-formed, circumferentially-spaced, quasi-cylindrical, key-hole-type, slot-forming means 29 about the periphery thereof. Each of the slot-forming means 29 includes a pair of elongated C-shaped members 49, 49′ having their concave surfaces facing opposite one another so as to form a slot 30 therebetween. Each slot 30 has a generally cylindrical inner portion 31 and a restricted neck portion 32, as previously described, and each slot 30 is adapted for slideably and telescopically receiving the slot-engaging portion 17 of a flap-like members 15 for replaceably mounting the pack units 14 on the hub structure 12. Each of the slots 30 has a longitudinal slot axis 33 which is parallel to the rotation axis 23 as previously described.

Each of the four sections 55 includes a pair of peripheral flange portions 59, 60 integral with the opposite sides of the arcuate shell-like central portion 57. A first one 59 of the pair of flange portions 59, 60 is spaced radially outwardly of the second one 60 of the pair of flange portions 59, 60 such that the radially outward flange portion 59 of one of the sections 55 is disposed closely over a second flange portion 60 of the circumferentially adjacent section 55 in an edgewise overlapping manner when the four sections 55 are fitted together to form the generally circular, radially outer cylindrical hub wall 56. When the four sections 55 are fitted together to form the circular cross-section, of the hub wall 56, four radially overlapping pairs of adjacent flange portions 59, 60 are produced, and each of the pairs of overlapping flange portions 59, 60 are provided with an aperture 61.

A plurality of clamping assemblies 62 are provided within the interior of the cylindrical hub wall 56 for securing the four radially overlapping pairs of flange portions 59, 60 tightly together to rigidly position the four sections 55 for retainably forming the cylindrical hub wall 56 and simultaneously for rigidly clamping the retainably formed cylindrical hub wall 56 to the shaft 13 for rotation therewith.

Figure 11:
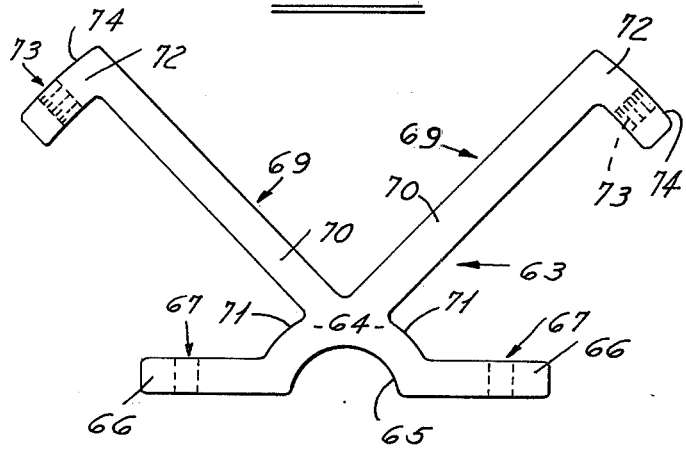
FIG. 11 is a fragmentary enlarged scale end view of one of the bracket clamps of the hub structure of FIG. 10.

As illustrated in FIGS. 10 and 11, each of the clamping assemblies 22 includes a pair of substantially identical clamping brackets 63. Each of the brackets 63 includes a radially inner, generally C-shaped, shaft-engaging portion 64 and the brackets 63 are adapted to be disposed on diametrically opposite sides of the shaft 13 so that the shaft 13 may be clampably retained between the concave radially inner surfaces 65 of the C-shaped portions 64.

Each of the brackets 63 also includes a pair of diametrically opposed, radially outwardly disposed bracket flange members 66 which are parallel with one another and integral with the opened sides of said C-shaped portions 64. Each of the bracket flange members 66 is provided with an aperture 67 adapted to receive a fastening means 68 such as a bolt-and nut assembly or the like through the apertures 67 so as to pull the first one of the pair of brackets flange members 66 toward a corresponding diametrically opposed first one of the pair of bracket flange members 66 of the opposite bracket 66 while a similar fastening means 68 through the apertures 67 of the second one of the pair of bracket flange members 66 of the first bracket 63 and the correspondingly opposed second one of the pair of bracket flange members 66 of the second bracket 63 tightly toward one another so as to at least partially encircle and clampably retain the shaft 13 therebetween so that the clamping assembly 62 will rotate therewith.

Furthermore, each of the brackets 63 includes a pair of angularly spaced, generally L-shaped members 69 each of which has one leg 70 integral with and extending generally radially outwardly from the convex radially outer surface 71 of the C-shaped portion 64 so as to position the second leg 72 of the L-shaped member 69 immediately radially inwardly beneath a radially disposed pair of overlapping flange portions 59, 60. Each of the second leg portions 72 include an internally-threaded aperture 73 and each has its radially outer surface contoured to fit tightly against the lower surface of the pair of overlapping flange portions 59, 60. An externally-threaded bolt-like member 75 is inserted through the apertures 67 of the overlapping flange portions 59, 60 to engage the internally-threaded apertures 73 of the second leg 72 of the L-shaped member 69 so as to securely fasten the overlapping pairs of flange portions 59, 60 rigidly to each corresponding second leg 72 of the brackets 63 for retainably forming the cylindrical hub wall 56 while simultaneously securing the wall 56 to the shaft 13.

The clamping assemblies 62 of the embodiment of FIGS. 9 and 10 may be disposed interiorly of the cylindrical hub wall 56 adjacent the axial ends 46 thereof or, alternatively, may be positioned at a plurality of locations along the length of the shaft. If desired, the slot-engaging portions 17 of the flap-like members 15, may be axially retained within the slots 30 by any of the types of retaining means 44 previously described and, in the embodiment of FIG. 9, the retaining means of FIG. 5 has been illustrated.

With this detailed description of the specific apparatus used to illustrate the prime embodiment of the present invention and the operation thereof, it will be obvious to those skilled in the art that various modifications can be made in the structures, materials and usages recited herein without departing from the spirit and scope of the present invention which is limited only by the appended claims.

I claim:

1. A hub structure for a rotary finishing wheel having a rotational axis and being adapted for replaceably mounting a plurality of circumferentially spaced pack units each of which includes a flap-like member of fill material having a radially outer finishing portion for engaging a workpiece and a radially inner slot-engaging portion for mounting said pack unit, said hub structure comprising two substantially identical hub sections generally representing the two halves of a longitudinally bisected cylinder, the radially outer surface of each of said hub portions having a generally semi-circular exterior contour provided with a plurality of integrally-formed, circumferentially-spaced, quasi-cylindrical, key-hole-type, slot-forming means each having a longitudinal slot axis parallel to said rotational axis, each of the longitudinal slots defined by said slot-forming means being adapted to slideably and telescopically receive the slot-engaging portion of said flap-like member to mount the pack unit for limited hinge-type pivotal movement about said slot axis, the interior of each of said hub portions including an integrally-formed, centrally-disposed, radially inwardly extending member having its inner end adapted to form a clamp seat having the general contour of the shaft to which said hub structure is to be secured, said member being generally normal to the plane of bisection of said hub portions, the interior of each of said hub portions further including a pair of flange portions generally parallel to said plane of bisection and integral with the longitudinally bisected edge portions of the hub portion, said flange portions extending radially inwardly toward one another and each having its radially inner end adapted to form onehalf of another shaft-engaging seat, said hub structure further including means for adjustably securing each of said pair of flange portions of one hub portion to corresponding opposed flange portions of the other hub portion to form a pair of oppositely disposed shaft-engaging seats from said flange portions while securely clamping said shaft between the clamp seats of the oppositely disposed members of the two hub portions to secure said hub structure to said shaft for rotation therewith and means for removeably retaining the slot-engaging means of said flap-like members axially within said longitudinal slots.

2. The hub structure of claim further characterized in that each of said hub portions is a one piece, integrally formed piece of relatively light-weight material.

3. The hub structure of claim 1 further characterized in that each of said hub portions is a one-piece, integrally-formed aluminum casting.

4. The hub structure of claim 1 further characterized in that the radially outer surface of each of said hub portions is relatively smooth, the radial thickness of the wall of said hub portions adjacent said members and said flange portions is greater than the radial depth of said slots and each of said slot-forming means includes integrally-formed, continuous slot-defining walls recessed radially inwardly of said outer surface.

5. The hub structure of claim 1 further characterized in that each of said slot-forming means includes a pair of integrally-formed, longitudinally-aligned, generally C-shaped members having their concave surfaces disposed opposite one another for forming said slot therebetween, said C-shaped members protruding radially outwardly from the generally semi-circular radially outer surface of said hub portions.

6. The hub structure of claim 1 further characterized in that said means for removeably retaining the slot-engaging means of said flap-like members within said longitudinal slots includes a first means for permanently closing one axial end of said slots and a second means for removealy closing the opposite axial end of said slots.

7. The hub structure of claim 6 further characterized in that said first means includes individual plug-like members receivably retained within said one axial end of each of said slots for permanently closing same.

8. The hub structure of claim 7 further characterized in that said second means includes means for providing internal threads in the opposite axial end of each of said slots and a plurality of individual threaded bolt-like elements adapted to be threadably received within each of said internally threaded slot ends for removeably closing said slots.

9. The hub structure of claim 7 further characterized in that said second means includes an annular plate and means for removeably securing said plate to the opposite axial end of said hub portions for closing said slots.

10. The hub structure of claim 1 further characterized in that said means for removeably retaining said slot-engaging means within said longitudinal slots includes a pair of annular ring-like plates adapted to be secured to the opposite axial ends of said hub portions for removeably closing the axial ends of said slots.

11. The hub structure of claim 10 further characterized in that each of said annular ring-like plates is comprised of two semi-circular portions each of which is adapted to be separately secured to one of said hub portions.

12. The hub structure of claim 10 further characterized in that the axial ends of said hub sections are provided with internally threaded apertures, said plates are provided with spaced apertures corresponding to said threaded apertures, and said retaining means further includes threaded bolt-like elements adapted to pass through said aperture and engage said internally threaded apertures for securing said plates removeably to said hub portions.

13. The hub structure of claim 1 further characterized in that said means for adjustably securing each of said pair of flange portions of one hub portion to correspondingly opposed flange portions of the other hub portion includes means providing a threaded aperture through each corresponding pair of opposed flange portions and a bolt-like threaded member adapted to be received in each pair of said apertures for threaded engagement therewith to adjustably force said opposed flange portions toward one another thereby clampably retaining said shaft between the oppositely disposed clamp seats of said inwardly extending members.

14. The hub structure of claim 13 further characterized in that at least one of said hub portions includes access openings through said radially outer surface for adjustably tightening and loosening said bolt-like members.

15. The hub structure of claim 1 further characterized in that said integrally-formed slots, said integrally-formed, inwardly extending clamp seat mounting members, and said integrally-formed flange portions extend substantially the entire axial length of said hub portions.

16. A hub structure for a rotary finishing wheel having a rotational axis and being adapted for replaceably mounting a plurality of circumferentially spaced pack units each of which includes a flap-like member of fill material having a radially outer finishing portion for engaging a workpiece and a radially inner slot-engaging portion for mounting said pack unit, said hub structure comprising four substantially identical, relatively thin-walled, cylindrical sections adapted to be placed in edgewise overlapping contact with one another to form a radially outer cylindrical hub wall for said hub structure, each of said sections including an elongated, arcuate shell-like portion whose radially outer surface is provided with a plurality of integrally-formed, quasi-cylindrical, key-hole-type, slot-forming means each having a longitudinal axis generally parallel to said rotational axis, each of the longitudinal slots defined by said slot-forming means being adapted to slideably and telescopically receive the slot-engaging portion of a flap-like member to mount the pack unit for limited hinge-type pivotal movement about said slot axis, each of said sections further including a pair of peripheral flange portions integral with opposite sides of said arcuate shell-like portion, a first one of said pair of flange portions of each of said sections being disposed closely over a second one of said pair of flange portion of each circumferentially adjacent section in an edgewise, radially overlapping manner when said four sections are fitted together to form said radially outer cylindrical hub wall, said hub structure further including a plurality of clamping means disposed substantially within said cylindrical hub wall (1) for securing the four pairs of radially overlapping flange portions tightly together to rigidly position said sections for retainably forming said cylindrical hub wall and (2) for rigidly clamping said retainably formed cylindrical hub wall to said shaft for rotation therewith.

17. The hub structure of claim 16 further characterized in that each of said clamping means includes a pair of substantially identical clamping brackets, each of said clamping brackets having a radially inner portion adapted to be clampably secured about said shaft for rotation therewith and a radially outer portion adapted to be rigidly secured to the flange portions of said sections for retainably forming said cylindrical hub wall.

18. The hub structure of claim 16 further characterized in that each of said clamping means includes first and second, substantially identical clamp brackets, each of said brackets having a generally C-shaped, shaft-engaging portion, said brackets being adapted to be disposed on diametrically opposite sides of said shaft such that said shaft may be clampably retained between the concave surfaces of said C-shaped portions, each of said brackets also including a pair of diametrically opposed, radially outwardly disposed bracket flange members parallel with one another and integral with the open sides of said C-shaped portion, the bracket flange members of said first bracket being adapted to be secured to the corresponding bracket flange members of said second bracket for clampably retaining said C-shaped portions about said shaft, each of said brackets further including a pair of angularly spaced, generally L-shaped members each having one leg integral with and extending generally radially outwardly from the convex surface of said C-shaped portion so as to position the second leg of each L-shaped member immediately radially inwardly beneath a radially disposed pair of overlapping flange portions and means for securing each of said overlapping pairs of flange portions rigidly to each corresponding second leg of each corresponding L-shaped member for retainably forming said cylindrical hub wall.

19. The hub portion of claim 18 further characterized in that each of said second legs has its radially outer surface contoured to conform to the inner surface of said second one of said flange portions and is provided with a threaded aperture, wherein said pair of overlapping flange portions are provided with corresponding apertures and wherein said means for securing each of said overlapping pairs to corresponding second legs includes a threaded bolt-like element insertable through the apertures of said overlapping pairs and into the threaded aperture of said second leg for operatively engaging same and securing said overlapping pair of flange portions and said second leg tightly together in a sandwiched fashion.

20. The hub structure of claim 19 further characterized in that each of said slot-forming means includes a pair of integrally-formed, longitudinally-aligned, generally arcuate members having their concave surfaces disposed opposite one another for forming said slot therebetween, said generally arcuate members protruding radially outwardly from the radially outer surface of said cylindrical hub wall.

21. The hub structure of claim 20 further characterized in that the apertured flange portions are disposed between two pairs of said arcuate members and the head of said threaded bolt-like element does not protrude radially beyond the outermost portion of said arcuate members.

22. The hub structure of claim 18 further characterized in that the bracket flange members of said first bracket and the correspondingly opposed bracket flange members of the second bracket are provided with threaded apertures and said hub structure further includes threaded bolt-like elements for threadedly engaging said apertures to force said first bracket flange members toward said second bracket flange members to clampably retain said shaft between the C-shaped portions of said first and second brackets.

23. The hub structures of claim 16 further characterized in that each of said four sections is a one piece, integrally-formed, aluminum casting.

24. The hub structure of claim 16 further including means for removeably retaining the slot-engaging portion of said flap-like members axially within said longitudinal slots.

25. The hub structure of claim 24 further characterized in that said means for removeably retain the slot-engaging portion of said flap-like members within said longitudinal slots includes first means for permanently closing one axial end of said slots and second means for removeably closing the opposite axial end of said slots.

26. The hub structure of claim 25 further characterized in that said first means includes individual plug-like members receivably retained within said one axial end of each of said slots for permanently closing same.

27. The hub structure of claim 26 further characterized in that said second means includes means for providing internal threads in the opposite axial end of each of said slots and a plurality of individual threaded bolt-like members adapted to be threadedly received within each of said internally threaded slot ends for removeably closing said slots.

28. The hub structure of claim 26 further characterized in that said second means includes an annular plate and means for removeably securing said plate to the opposite axial end of said hub portions for closings said slots.

29. The hub structure of claim 24 further characterized in that said means for removeably retaining said slot-engaging portions within said longitudinal slots includes a pair of annular ring-like plates adapted to be secured to the opposite axial ends of said hub portions for removeably closing the axial ends of said slots.

30. The hub structure of claim 29 further characterized in that each of said annular ring like plates is comprised of two semi-circular portions, each of which is adapted to be separately secured to one of said hub portions.

31. The hub structure of claim 29 further characterized in that the axial ends of at least some of said slots are provided with internal threads, said plates are provided with spaced apertures corresponding to said threaded slots, and said retaining means further includes threaded bolt-like elements adapted to pass through said apertures and engage said threaded slots for securing said plates removeably to said hub portions.

32. The hub structure of claim 16 further including plug-like elements adapted to be retainably received within the axial ends of said slots for closing same to retain said slot-engaging portions therein.

* * * * *